US007726486B2

(12) United States Patent
Jones

(10) Patent No.: US 7,726,486 B2
(45) Date of Patent: Jun. 1, 2010

(54) PACKAGE WITH TRAP DOOR

(75) Inventor: Marty Jones, Graham, NC (US)

(73) Assignee: MeadWestvaco Corporation, Richmond, VA (US)

( * ) Notice: Subject to any disclaimer, the term of this patent is extended or adjusted under 35 U.S.C. 154(b) by 965 days.

(21) Appl. No.: 11/463,773

(22) Filed: Aug. 10, 2006

(65) Prior Publication Data

US 2007/0034543 A1 Feb. 15, 2007

Related U.S. Application Data

(60) Provisional application No. 60/707,849, filed on Aug. 12, 2005.

(51) Int. Cl.
*B65D 83/04* (2006.01)

(52) U.S. Cl. ..... 206/562; 53/462; 53/170; 229/87.05

(58) Field of Classification Search ..... 206/528, 206/531, 532, 535, 536, 538; 229/87.05; 53/449, 450, 461, 462, 467, 443, 170
See application file for complete search history.

(56) References Cited

U.S. PATENT DOCUMENTS 5,927,500 A * 7/1999 Godfrey et al. ..... 206/531
7,051,876 B2 * 5/2006 Grosskopf ..... 206/462
2001/0009231 A1 * 7/2001 Danville ..... 206/532
2007/0221534 A1 * 9/2007 Intini ..... 206/532
2009/0288978 A1 * 11/2009 Prud'Homme ..... 206/532

* cited by examiner

*Primary Examiner*—Jacob K Ackun, Jr.
(74) *Attorney, Agent, or Firm*—Alison R. Scheidler; Tsugihiko Suzuki

(57) ABSTRACT

A package 12 comprises a top panel 14 and a bottom panel 18, which are partially or totally laminated with tear resistance material for enhancing the structural integrity of the package 12. Severance lines form at least one front panel 30 and at least one back panel 44. The front panel 30 includes a tear notch 42*a* and at least one aperture 32. The back panel 44 includes a severance line 54. In one embodiment the panels 14, 18, 30, 44 are folded and attached, to form at least one trap door 58, and encapsulating at least one blister 34 holding an item. The trap door 58 is releasably attached within the top panel 14 and bottom panel 18. To gain access to a blister 34, a trap door 58 is at least partially detached along the severance lines 36, 48, and pushed out to access the tear notch 46. A portion of the trap door 58 is torn, at tear notch 46 and along the severance line 54, to access the item.

4 Claims, 5 Drawing Sheets

PACKAGE WITH TRAP DOOR

RELATED APPLICATIONS

This application claims priority to U.S. Provisional Patent Application No. 60/707,849, filed Aug. 12, 2005, the entirely of which is incorporated herein.

FIELD OF INVENTION

The present invention relates to a packaging system for packaging and dispensing products and, more specifically, to a system comprising a detachable panel and severance line that together provide an improved apparatus and method for dispensing one or more items.

BACKGROUND OF THE INVENTION

Unit dose packaging is an attractive packaging format that is used for a variety of applications. Examples of dose packaging include the well known blister package or blister card, the most common use being to contain articles such as, tablets, pills, capsules, candy and similar consumable items. Conventional blister packages generally include a blister pack that typically comprises a thermo-formed plastic sheet containing integrally formed blisters that are dimensioned to hold one or more articles. Articles are disposed within each blister and the plastic sheet is sealed to a backing sheet that normally comprises a foil, plastic film, or paperboard barrier. The backing sheet is applied to cover each blister and securely houses the articles therein, and is punctured or ruptured to release an item from a blister. Typically with paperboard barriers, gates are formed proximate to each blister to assist with removing the contents from the blister. Each gate is deformed or manipulated so that it ruptures or partially separates from the rest of the barrier, allowing the item within a blister to be pushed through the gate.

Other examples of conventional blister packages comprise a front and back paperboard sheet that are adhered together to sandwich a blister or blister pack between the two sheets. In this configuration, the blister protrudes through an aperture formed within the front sheet. The back paperboard sheet generally includes one or more gates or tear-away strips that overlay a respective one or more blisters. To access an item stored in the blister the item is typically forced through the backing sheet from the blister. While the conventional blister packages are suitable for many applications, there remain shortcomings. The conventional blister packages provide removal of the items from the blister cells, but offer no or very little child resistance. Child resistance is a feature that is particularly desired for unit dose pharmaceutical packaging, and is mandated by the Poison Prevention Packaging Act of 1970. Guidelines are prescribed for packaging to satisfy the criteria for child resistance. For example, a child resistance (CR) rating of F=1 requires that a random sampling of the subject packages not be compromised by an age specific test pool of children for a specific failure rate. This guideline is designed to ensure that the package has sufficient integrity against tampering or unauthorized access by children.

Measures taken to provide blister packages with child resistant features have generally included adding additional or thicker push-through films, applying stronger adhesion of peel films or tear-away strips, forming backings comprising heavier substrates, or adding a variety of locking mechanisms that require a combination of steps for exposing a blister. A downfall of the added safety features is that the blister package can be difficult to open by a user, is expensive and over packaged. For example, one result of added materials is that certain articles crumble when attempting to dispense the article from the reinforced backing sheet of the blister pack.

In addition to a blister package being child resistant, it is desirable that the package permit easy withdrawal of items from the package by those intended to use the item stored therein, such as an adult taking a prescription. As the blister packages are designed to be more resistant to tampering by a child, the elderly may have difficulty gaining access to the pharmaceutical dosage of medication within the package. This is especially important for users or patients whose manual dexterity and strength is reduced.

Regarding a variation of the child-resistant but senior-friendly issues presented above, clam shell packages are frequently used for many products—pharmaceutical or otherwise. An advantage of clam shell packages is that they deter on-site theft because these packages are typically constructed of relatively resistant plastics, and are thus relatively difficult to open without a sharp tool. Even a consumer who has purchased a clam shell packaged product cannot typically gain entry into the package until they have opened the package with a sharp tool. Alternatives to claim shell packages include the Natralock™ brand security package manufactured and distributed by the present Applicant. Embodiments of the Natralock™ brand package include a contiguous paperboard substrate that supports at least one item captured by a single tear-resistant layer or wrap, such as an APET bubble. Other embodiments of the Natralock™ brand package include a two-piece paperboard frame that support opposing walls of tear-resistant material, between which is captured an item. While it is typically much easier to access an item packaged in a Natralock™ brand product than a clam shell package, such access still typically is with a tool.

Accordingly, there remains in the art a need for a packaging system that is economical to manufacture and assemble, light weight, and provides child-resistant or theft-resistant security features. There also remains a need for a packaging system that permits withdrawal of the item stored therein without the use of a tool, and with little manipulation by those that purchased the item and/or are expected to use the item.

SUMMARY OF THE INVENTION

The present invention overcomes the deficiencies of the known art and the problems that remain by exploiting the gap in the cognitive abilities between the typical unintended user (a child) and the typical intended user (an adult). Here, a package that meets the needs for child-resistance yet is senior-friendly is a package that includes at least one trap door that is releasably attached within a panel along a severance line. The trap door includes a first door panel and a second door panel, each door panel including a notch cut and/or a severance line. An item, positioned within a blister or captured between opposing spans of material, is disposed between the door panels and the door panels are attached. The notch cuts and/or severance lines align to form a tear line for assisting a user in tearing either panel of the trap door. In alternative embodiments one door panel includes a severance line that extends from the trap door perimeter toward the item, and the severance line may be of any length or configuration.

To gain access to the item, a user pushes the trap door along a perimeter severance line to at least partially detach the trap door from the plane of the surrounding panel. The user then begins tearing the substrate of the trap door by pulling along the tear notch, and tearing, peeling, or otherwise delaminating the substrate along a tear line. In one embodiment the tear line directs the delamination to the center of the back panel of the trap door, thereby increasing access to the back of the blister cavity or exposing it altogether. Pressure is applied to the blister to direct an encapsulated item to rupture the backing sheet of the blister and any remaining portion of the substrate, thereby releasing the item from the blister. In alternative embodiments access is increased to the item stored, whether in a blister or not.

In another aspect, there is provided a package that is at least partially laminated with a suitable material to provide structural integrity and reinforcement to the child-resistant package. The package may be constructed of a cardboard, paperboard, plastic, or a tear-resistant paperboard substrate material such as, but not limited to, DuraSeal® and EasySeal Plus® brand paperboard products available through the Applicant. Further, alternative package embodiments may or may not include information that is printed on any surface of the blister package. Alternatively, one embodiment may include a pocket formed within the cover of the blister package or an extension panel foldably attached to any panel of the package for housing or accommodating an insert comprising information. An example of the information may include dosage or product information, compliance instructions, coupons, promotional material, date, time, or any other information.

In accordance with one embodiment of the present invention, there is provided a packaging system comprising: a package including a plurality of hinge panels and a plurality of spine panels, the plurality of hinge panels and the plurality of spine panels being operatively connected to each other; wherein a first hinge panel includes at least a first door panel that is releasably attached to the first hinge panel, the first door panel including a tear notch and at least one aperture; and further wherein a second hinge panel includes at least a second door panel that is releasably attached to the second hinge panel, the second door panel including a severance line that is cooperatively aligned with the tear notch. In some alternative embodiments, no spine panels are present.

The blister package further includes a blister pack including at least one blister that encapsulates at least one item to be dispensed. The first hinge panel is foldably attached to the second hinge panel sealing the at least one blister between the door panels. The door panels combine to form at least one releasably attached trap door, and severance lines or cut notches or a combination of those combine to form a tear notch in the at least one trap door.

Regarding the embodiments illustrated or described herein, as well as those covered by the claims, the blister package may or may not include one or more gates that are formed within the back substrate of each trap door for providing additional security for retaining one or more items within a blister. Further, the blister package of the present invention may be disposable once all the items have been removed. In addition, the blister package may be designed to include any shape or dimension that corresponds with a packaging blank.

The invention includes a method of packaging items. In one embodiment the first step is cutting a blank from a substrate material. The blank is then folded to form a package. The package comprises a plurality of hinge panels that are operatively connected to each other; wherein a first hinge panel includes at least a first door panel that is releasably attached to the first hinge panel, the first door panel including a tear notch and at least one aperture; and further wherein a second hinge panel includes at least a second door panel that is releasably attached to the second hinge panel, the second door panel including a second tear notch and/or a severance line to form a means for tearing the trap door; the trap door that is formed when the first and second door panels are placed in a face contacting orientation. In some embodiments the trap door captures a blister that contains an item and in other embodiments the trap door supports opposing spans of material that hold an item.

The method of packaging also includes encapsulating at least one item into at least one blister and attaching the first hinge panel to the second hinge panel so that the at least one blister is sandwiched between the door panels. The door panels are attached together to form at least one releasably attached trap door including a tear notch and a severance line to form a means for tearing the trap door.

Another embodiment of the present invention includes a method of dispensing at least one item from a package. After acquiring a package with at least one trap door that is releasably attached within a hinge panel, pushing the trap door to at least partially disengage the trap door from the hinge panel along a severance line to expose a tear notch formed within the trap door. Another step is grasping the edges of the tear notch and peeling a portion of the trap door along a tear line to expose at least a portion of a blister or provide a partial portal to the item. The next step is applying force to the blister to direct the at least one item out of the blister or further tearing to expand the portal and retrieve the item.

As the present invention is scalable in its application, some package and trap door embodiments may be small, such as a dense blister pack holding computer processing chips that provide a trap door aligned with each blister. Alternatively, some package and trap door embodiments may be fairly large, such as a single Natralock™ brand package holding a cellular telephone that provides a single trap door that must be manipulated to access the telephone.

DETAILED DESCRIPTION

As required, detailed embodiments of the present invention are disclosed herein. It must be understood that the disclosed embodiments are merely exemplary of the invention that may be embodied in various and alternative forms, and combinations thereof. As used herein, the word "exemplary" is used expansively to refer to embodiments that serve as an illustration, specimen, model or pattern. The figures are not necessarily to scale, and some features may be exaggerated or minimized to show details of particular components. In other instances, well-known materials or methods have not been described in detail in order to avoid obscuring the present invention. Therefore, specific structural and functional details disclosed herein are not limiting but serve as a basis for the claims and for teaching one skilled in the art to variously employ the present invention.

The present invention is applicable to the packaging, storing, and dispensing of various products. For the purposes of teaching and not as a limitation, the illustrated embodiments are directed to a package for dispensing pharmaceutical products. Accordingly, the terms "unit", "dose", "article", "item" or "product" as used herein include pharmaceutical preparations, tablets, pills, capsules, lozenges, chewables, vitamins, supplements, non-medications, as well as all manner of small and portable items or products that a user may wish to keep secure and dispense. Further, the terms, "top", "bottom", "face", "back" "first" and "second" as used herein, are merely directional in order to distinguish one surface from another, and are not limitations. In addition, terms used to refer to a severed line of any kind, terms such as "cut", "notch", "tear notch", "frangible line", "severance line", "tear line", whether in the singular or plural and combinations thereof, includes but is not limited to perforations, a line of perforations, a line of short slits, a line of half cuts, a single half cut, a single slit, any combination of perforations, slits, and half cuts, short score lines, and the like or the equivalent.

Figure 1:
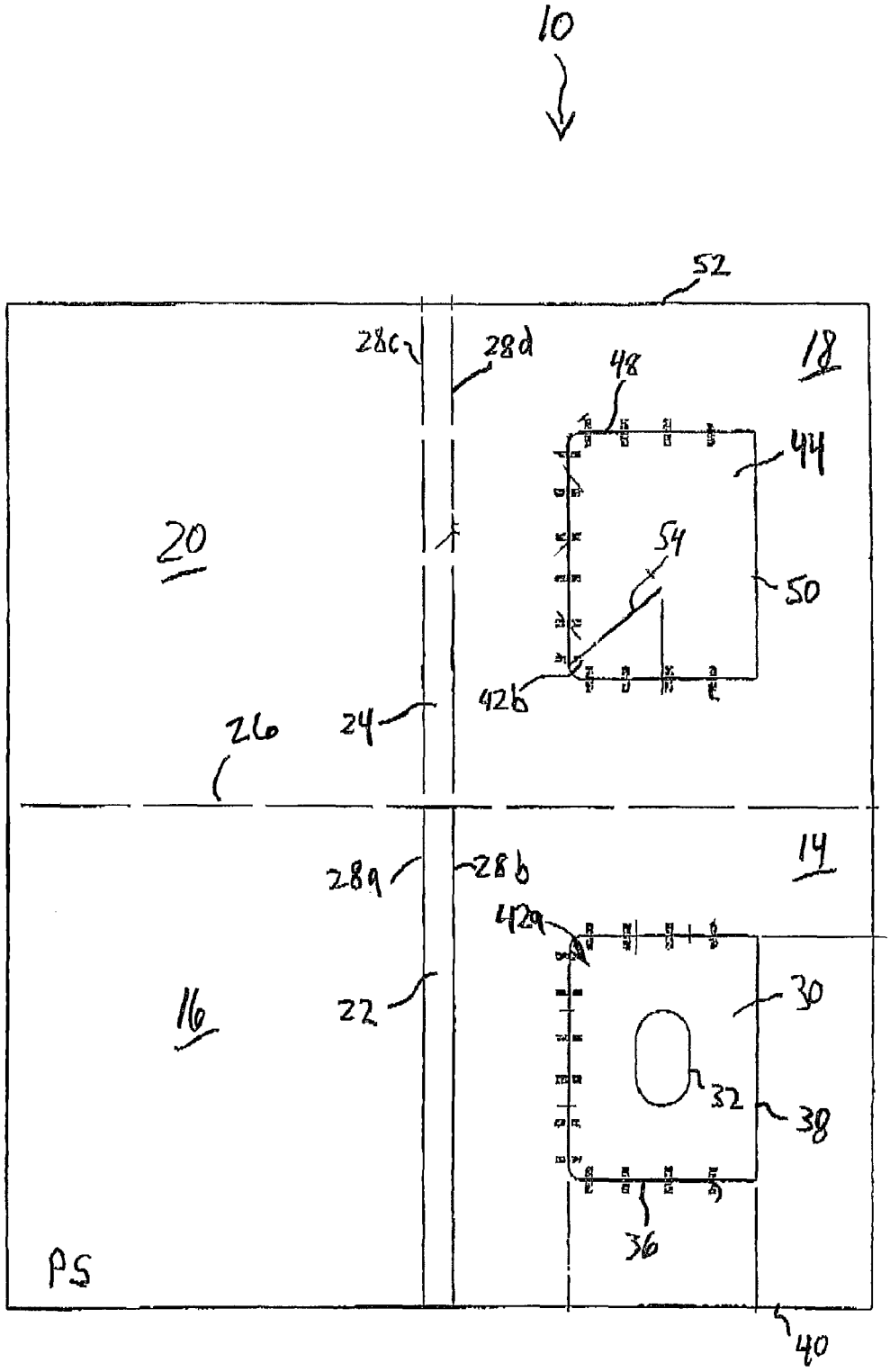
FIG. 1 is a plan view of an embodiment of a package blank, according to the present invention.

Referring now to the drawings, wherein like numbers represent like elements throughout, FIG. 1 is a plan view of the illustrated blank 10 for forming an embodiment of a blister package 12, best shown in FIGS. 2-5. The blank 10 is shown with the printed side PS facing the viewer. The blank 10 comprises a top panel 14, a top extension panel 16, a bottom panel 18 and a bottom extension panel 20. Between the top panel 14 and top extension panel 16 is a spine panel 22, and between the bottom panel 18 and bottom extension panel 20 is spine panel 24. The top panel 14 and top extension panel 16 are hingedly connected to the bottom panel 18 and the bottom extension panel 20, respectively, along a transverse fold line 26 that spans the width of the blank 10. The spine panel 22 is defined by longitudinal fold lines 28*a*, 28*b*, and spine panel 24 is defined by longitudinal fold lines 28*c* and 28*d*.

Figure 2:
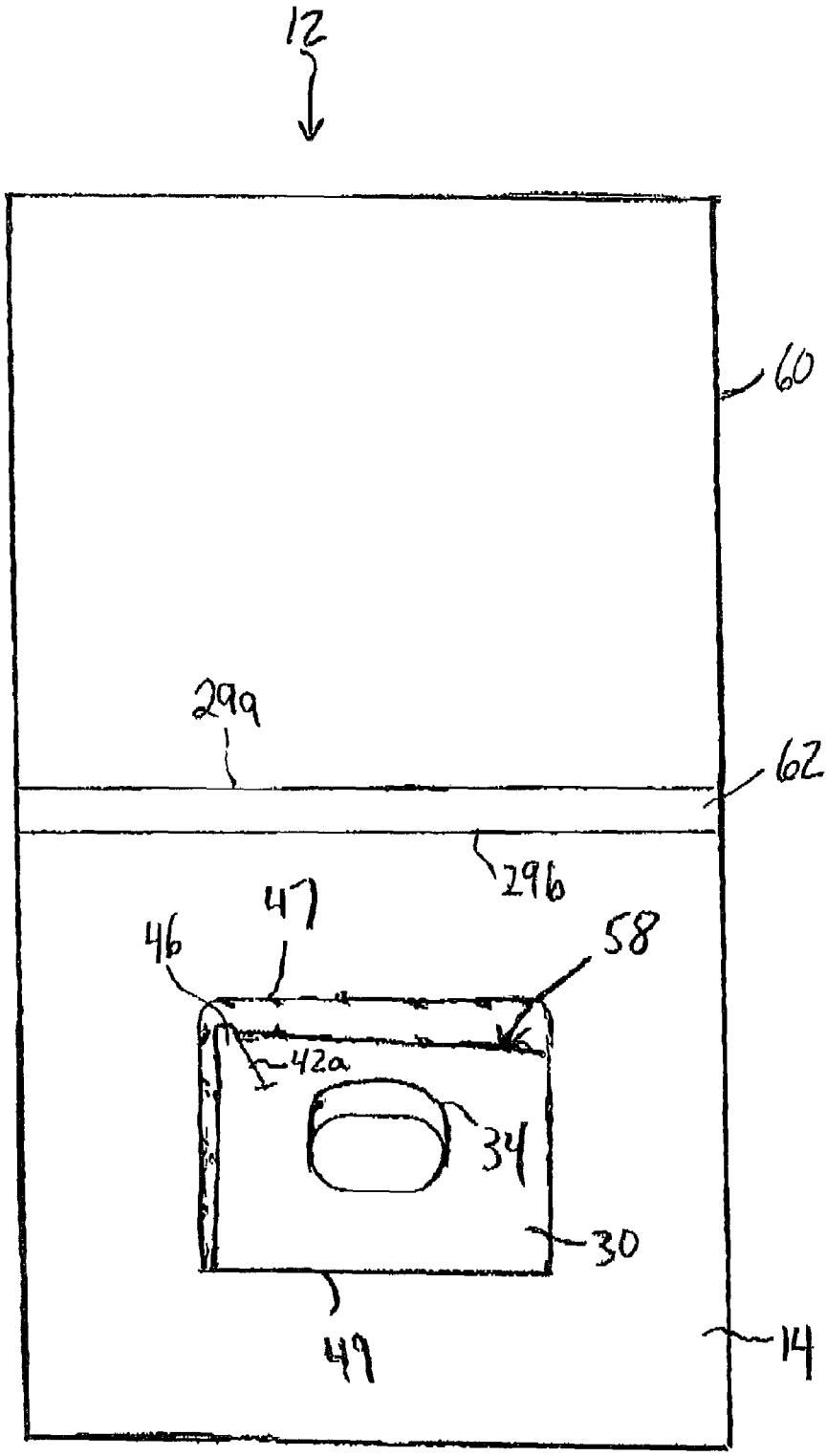
FIG. 2 is a plan front view of a blister package including a trap door, according to the present invention.

Continuing with reference to both FIGS. 1 and 2, the top panel 14 includes a front panel 30 having at least one aperture 32 for receiving a blister 34. The aperture 32 is dimensionally designed to correspond with the shape and size of the blister 34. A severance line 36 is formed within the substrate of the top panel 14. The severance line 36 can vary in depth, shape, and size, as needed to form the front panel 30, partially surround the aperture 32, and permit the front panel 30 to be releasably detached from the plane of the top panel 14. As used here and throughout the specification, the term "releasably detached" and all variations thereof, is used broadly to include both partially and fully separating one panel or panel portion from another, including a trap door from a surrounding panel or panel portion.

In this illustrated embodiment, the configuration of the severance line 36 begins at fold line 38 and extends partially parallel with a first top panel edge 40 of the top panel 14. The severance line 36 then extends perpendicularly to the first top panel edge 40 and parallel to fold line 38. The severance line 36 then again runs parallel with the first top panel edge 40 to terminate at fold line 38. As shown, the severance line 36 is formed in the substrate of the top panel 14 and oriented to surround at least three sides of the aperture 32. In alternative embodiments cuts 36 are configured to form front panels of various shapes and configurations.

Figure 3:
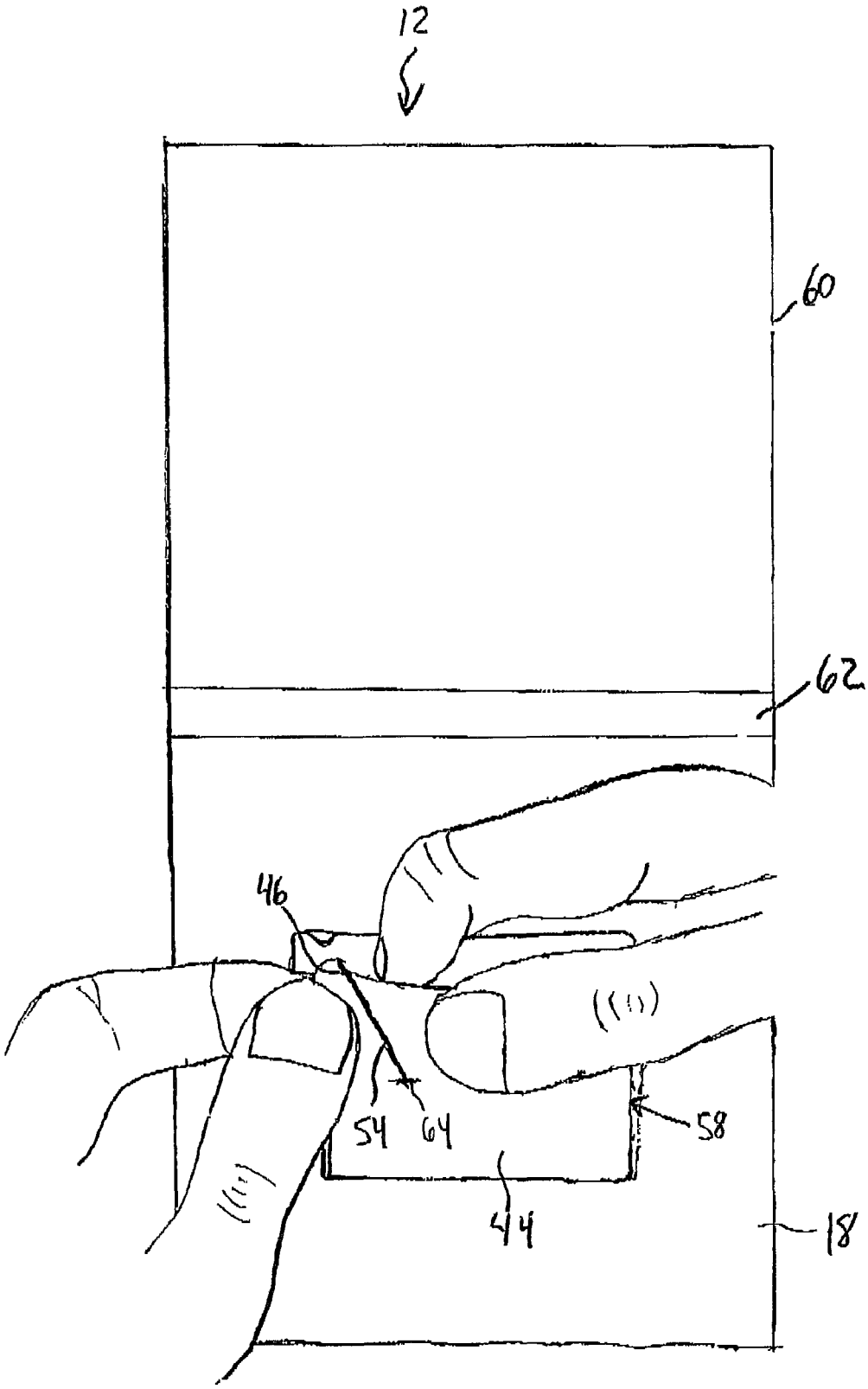
FIGS. 3 and 4 are plan rear views of the blister package of FIG. 2.

The front panel 30 further includes a front panel notch cut 42*a* that is formed at an angle within the substrate of the front panel 30 and cut to extend partially towards the center of the aperture 32. The front panel notch cut 42*a* correspondingly aligns with a back panel notch cut 42*b* that is formed within the back panel 44. The panel notch cuts 42*a*, 42*b* combine to form a tear notch 46, as best illustrated in FIGS. 2 and 3. The tear notch 46 provides a mechanism for aiding a user in initiating the tearing, peeling, or delaminating of the substrate of the back panel 44 as explained in detail below.

The bottom panel 18 includes a back panel 44 that correspondingly aligns with the front panel 30 of top panel 14. A severance line 48, like the severance line 36 described above, together with the fold line 50, defines the back panel 44. It will be noted that although both the front panel 30 and back panel 44 are hingedly attached to the top panel 14 and back panel 18 along fold lines 38 and 50, respectively, the fold lines 38, 50 may alternatively comprise frangible or severance lines for allowing a trap door 58 to be completely removed from the blister package 12, as described below.

As illustrated in the embodiment of FIG. 1, a severance line 54 is formed within the substrate of the back panel 44. The severance line 54 begins at the severance line 48, at one edge or corner of the back panel 44, and extends at an angle and partially within the substrate of the back panel 44. The severance line 54 terminates substantially at the center of the back panel 44 to correspond with the center of the aperture 32. A first portion of the severance line 54 defines a back panel notch cut 42*b*. The back panel notch cut 42*b* provides a starting point to begin tearing a portion of the back panel 44. The severance line 54 directs the tearing, peeling or delaminating of the back panel to improve access to the corresponding blister 32. In alternative embodiments the severance line 54 is positioned on the top panel 30 to direct the tearing, peeling or delaminating of the top panel to improve access to the corresponding blister. Alone or in combination with the each other, panel notch cuts 42*a*, 42*b* and severance line 54 provide a means for tearing a trap door.

It will be noted that the exemplary configuration provided for the blank 10 is only illustrative of one embodiment of the present invention and the illustrated configuration is neither limiting nor the only configuration possible. Accordingly, the blank 10 may comprise a variety of different dimensions, layouts, configurations, sizes and shapes as may be desired by those skilled in the art. For example, a plurality of full or partial depth cuts may be formed within the front panel 30, the back panel 44 or both, in any configuration and/or orientation in order to provide one or more tear notches 46. In addition, a plurality of severance lines 54 may be configured, oriented and formed within the back panel 44 or front panel 30 in order to provide a particular degree or percent of control cut for directing the tearing of the substrate along the respective panel.

The blank 10 may comprise paperboard, plastic, cardboard, or any other suitable material. The selection of this material may be made according to the packaging needs. For example, a material selected for medicines should be recognized as safe by the Food and Drug Administration. In certain preferred embodiments, the material may be selected from a sheet of bleached sulfate board, a sheet of solid unbleached sulfate board (SUS), clay-coated newsback (CCNB), or any other suitable board material. In other examples, the paperboard may be clay-coated on one side (C1S) or both sides (C2S) with a coating such as a fluidized blend of mineral pigments. The mineral pigments may be coating clay, calcium carbonate, or titanium dioxide and may be combined with starch or adhesive. Successive densification and polishing (via calendaring) finishes each coated surface to a high degree of smoothness and renders it suitable for printing graphics of superior quality.

In the illustrated embodiments the panels are constructed of DuraSeal® or EasySeal Plus® brand paperboard products, available through the Applicant. In an alternative embodiment, at least part of one or both sides of the blank 10 is laminated with a tear resistant material, such as a polymer film. In this manner, the exterior of the blister package 12 is made more resistant to tearing. Optionally, this lamination may not extend over the entire surface of the blank 10 since only tear prone regions may require lamination. Suitable laminating materials may be selected from biaxially oriented or cross-laminated polymeric films such as high density polyethylene (HDPE), polyolefins, polyesters or combinations thereof. In a related embodiment, tear resistance may be provided at stress points, such as the package corners, exposed edges, and fold areas, by applying one or more strips of the polymeric film over these areas. In either aspect, the polymeric film may be applied by extrusion, adhesive lamination, or by any other suitable means known in the art. The polymeric film is typically applied to the side that is the interior surface of the blank 10. Text or graphic information may be printed on any surface of the blister package 12 according to any means conventionally known in the art.

Turning now to the erection of the blank 10, with a view to FIG. 1, FIG. 2 represents an erected blister package 12 according to a sequence of folds. It will be understood by those skilled in the art that the particular sequence of folds discussed below are neither limiting nor the only sequence of folds possible to erect the blister package 12 from the blank 10. To construct the illustrated blister package 12, at least one item containing blister 34 is disposed between the front panel 30 and the back panel 44. The bottom panel 18 and bottom extension panel 20 are folded along fold line 26 and matingly sealed to the top panel 14 and top extension panel 16, respectively. The panels 14, 16, 18, 20, 30 and 44 are sealed together by any means known in the art, including but not limited to gluing and heating processes known to those skilled in the art. In this configuration, the blister 34 is sandwiched between and protected by the front panel 30 and back panel 44 so that the blister 34 protrudes through the aperture 32 of the front panel 30. The severance line 48 and fold line 50 of the back panel 44 matingly align with the severance line 36 and fold line 38 of the front panel 30 to form a single severance line 47 and fold line 49. Fold lines 28*a*, 28*b* correspondingly align with fold lines 28*c* and 28*d*, respectively, forming cover fold lines 29*a* and 29*b*. The front panel 30 and the back panel 44 are sealed together to form a trap door 58.

The top extension panel 16 and back extension panel 20 are attached together to form a cover 60. The cover 60 is hingedly folded along cover fold lines 29*a* and 29*b* for storing and protecting at least one blister 34, and side panels 22, 24 form a spine 62 of the blister package 12.

In another embodiment, the top extension panel 16 and bottom extension panel 20 may be sealed together along the outer perimeter to form an interior pocket for receiving an information insert. Example information may include dosage or product information, compliance instructions, coupons or any other information. In this exemplary embodiment, the cover 60 may or may not include an access notch to access and withdraw the contents of the interior pocket. In alternative embodiments, information may or may not be printed on any surface of the panels 14, 16, 18, 20, 30 and 44 of the blister package 12.

With continued reference to FIG. 2, to gain access to at least one blister 34, a user applies pressure to the trap door 58 along the severance line 47, and pushes the trap door 58 through the plane of the top panel 14. The trap door 58 detachably releases from the blister package 12 and is folded about fold line 49, readily exposing the tear notch 46. In one exemplary embodiment, the trap door 58 may be fully detached from the blister package 12 along a severance line.

Figure 4:
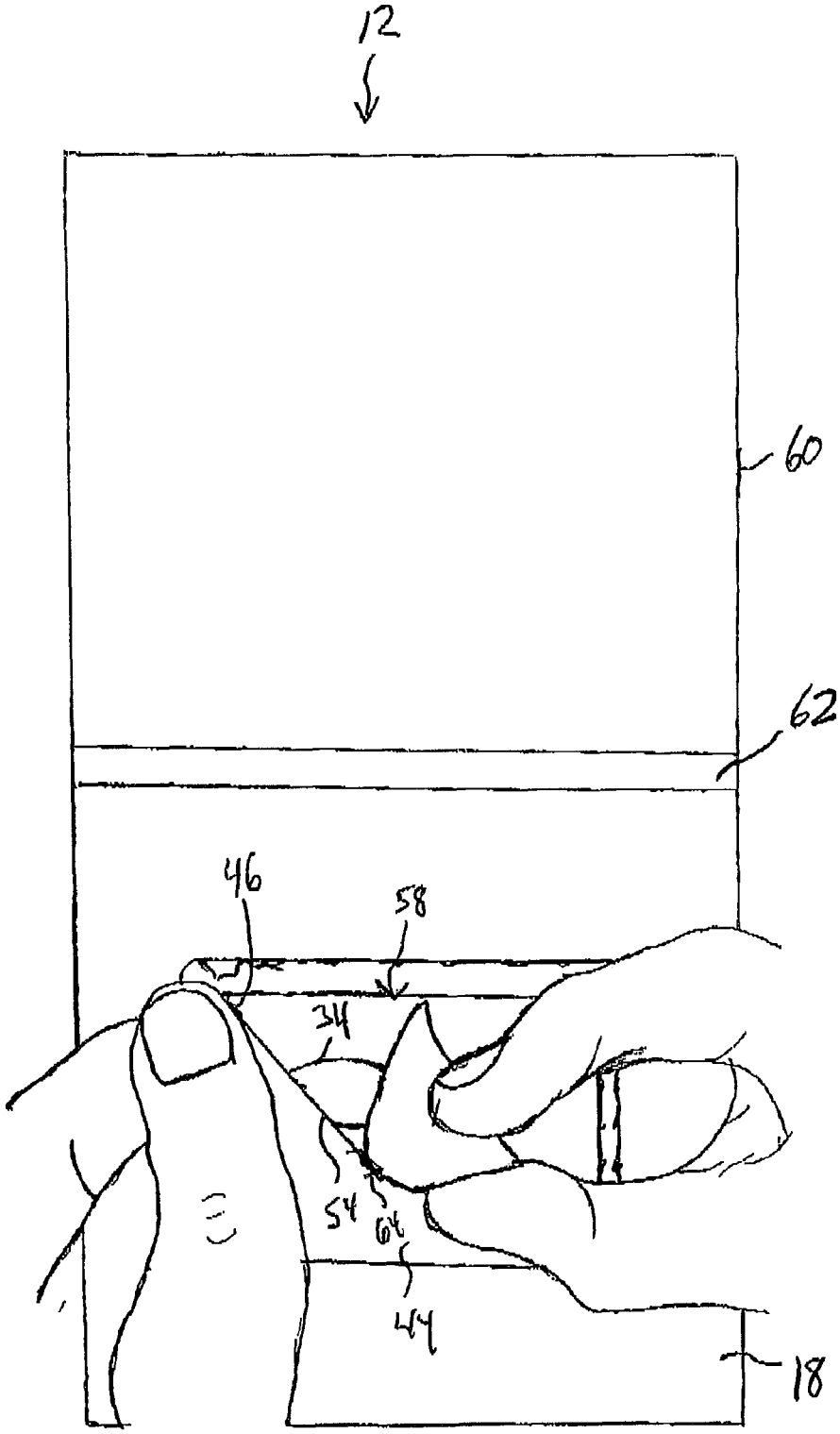

Turning now to FIGS. 3 and 4, there are shown plan rear views of the blister package 12, according to the present invention, showing sequential steps for accessing a blister 34. As illustrated in FIG. 3, to gain access to an item within a blister 34, a user securely holds one edge of the trap door 58 with one hand, aligning a finger and thumb of that hand adjacent the tear notch 46. With a finger and thumb of the other hand, the user begins tearing the back panel 44 of the trap door 58 along the tear notch 46.

With a continued pulling motion, the user tears the substrate of the trap door 58 along severance line 54, as shown in FIG. 4. The severance line 54 directs the tearing, peeling or delaminating of the back panel 44 substrate, and improves access to the blister 34. As shown, a large portion of the back panel 44 is peeled or torn away from the trap door 58, substantially along the severance line 54, thereby exposing the back or backing sheet of a corresponding blister 34. The peel-away section of the trap door 58 may remain attached or the user may completely remove the torn section from the trap door 58. To gain access to an item within the corresponding blister 34, pressure is applied to the blister 34 and the applied force directs the item to rupture the backing sheet of the blister 34 and the remaining substrate of the back panel 44.

In one alternative embodiment of the present invention, the blister package 12 may comprise a back panel 44 including one or more gates. The gates may be formed within the substrate of the back panel 44, and dimensioned to correspondingly overly a blister 34. When tearing a portion of the trap door 58, the substrate of the back panel 44 delaminates to expose a corresponding gate. Each gate is deformed or manipulated so that it ruptures or partially separates from the back panel 44, thereby allowing an item to be released from a blister 34.

Figure 5:
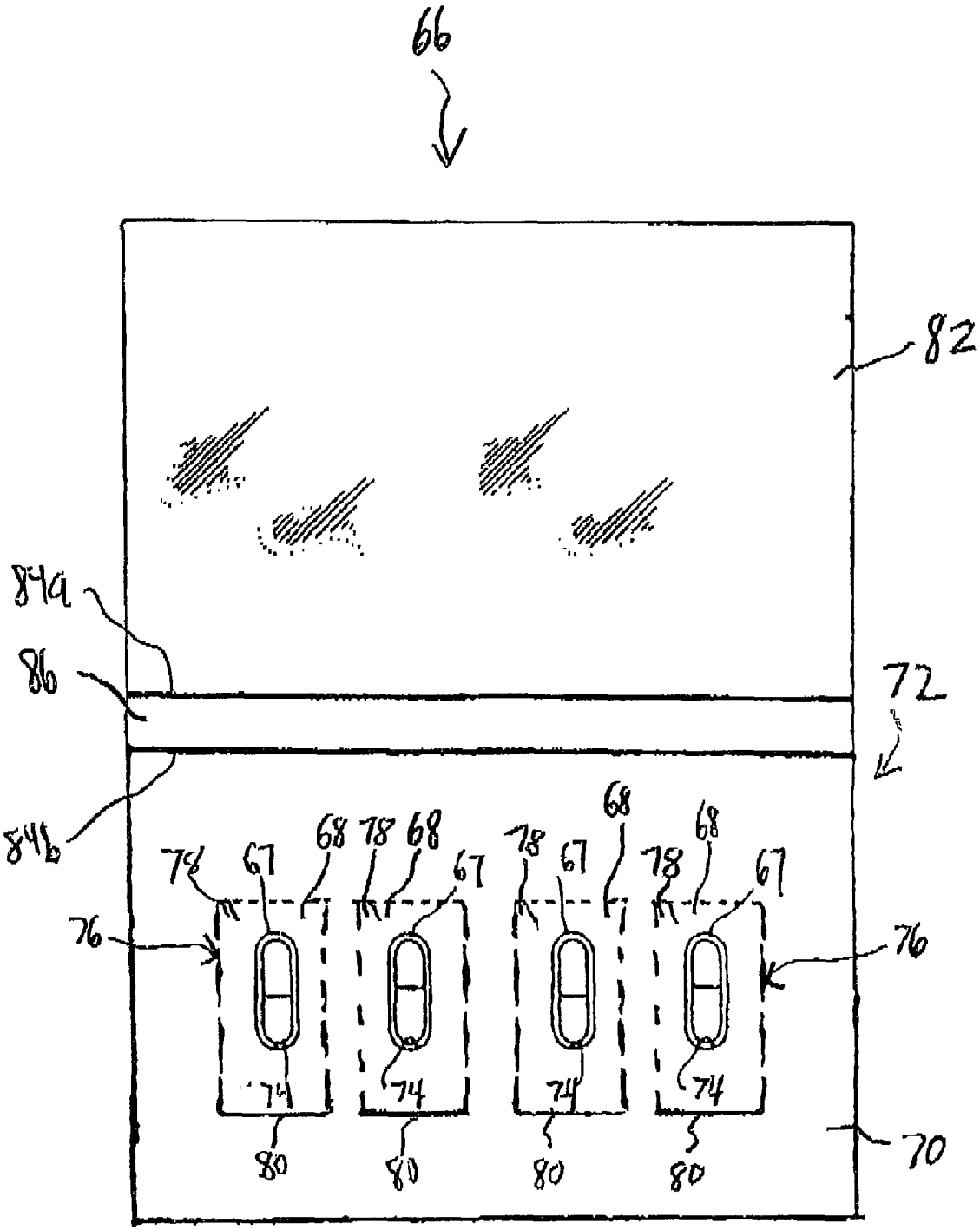
FIG. 5 is a plan view of a blister package, according to an alternative embodiment of the present invention.

The blister package 12 may or may not be designed for a one time use and destroyed once a blister 34 has been accessed. A further embodiment of the present invention includes a blister package 66 comprising a plurality of trap doors 68 for providing multiple dosage units, as illustrated in FIG. 5. The blister package 66 of FIG. 5, includes the same elements and features as that shown in FIG. 1, with additional front panels and back panels forming a plurality of trap doors 68. For purposes of simplicity, the particular elements shown in FIG. 1 will not be repeated and described with reference to FIG. 5.

A blister pack including a plurality of blisters is sandwiched between a top panel 70 and a bottom panel 72 so that each blister is sealed within a trap door 68. The blister pack may comprise a plurality of blisters that are arranged in a variety of different layouts and/or configurations, and each blister encapsulates at least one dosage to be dispensed. Each blister protrudes through an aperture 74 formed within a front panel of each trap door 68.

As shown in FIG. 5, each trap door 68 is releasably attached within the top panel 70 along a corresponding severance line 76. Each severance line 76 is configured to releasably detach a corresponding trap door 68 from the plane of the top panel 70. Severance lines are formed within each front panel and each back panel to provide a trap door 68 including a tear notch 78. The tear notch 78 is dimensioned to aid a user to begin tearing a portion of the substrate of each trap door 68.

To gain access to at least one blister, a user pushes the trap door 68 through the plane of the top panel 70 and detachably releases the trap door 68 along the severance line 76. As described earlier, a blister is sandwiched within the trap door 68 between a front panel and a back panel. Thus, in order to facilitate detachment of a blister from the blister pack, each blister is attached to each other along perforated tear lines. The perforated tear lines formed within the blister pack correspondingly align with the severance line 76. Therefore, detaching a trap door 68 along the severance line 76 also detaches a blister along the corresponding perforated tear lines of the blister pack. The trap door 68 is folded about a fold line 80 and the tear notch 78 is readily exposed.

A user holds one edge of the detached trap door 68 with one hand and using a finger and thumb of the other hand, begins to tear the substrate of the trap door 68 along the tear notch 78. The user continues to tear or peel a portion of the trap door 68 along a tear line formed within the substrate of a back panel, as similarly illustrated in FIGS. 3 and 4. The tear is directed to continue along the tear line to the center of the trap door 68, thereby exposing the backside of a blister. Pressure is applied to the blister. The applied force directs the item to rupture the backing sheet of the blister, thereby releasing the item from the blister.

The blister package 66 includes a cover 82 and fold lines 84*a*, 84*b* that form the spine 86 of the blister package 66. The cover 82 is folded along the fold lines 84*a*, 84*b* to store and protect the remaining blisters therein.

The package of the present invention offers advantages in that it is lightweight, tear-resistant, durable, easy and economical to construct, and offers protection of each unit dose until each dose is consumed. Moreover, the invention provides a child resistant, yet user-friendly, unit dose package that is used to contain, store and dispense a variety of products. Tamper resistant features of the package may be attributed, at least in part, to a trap door for releasably housing at least one blister, a tear notch for tearing the substrate of the trap door along a tear line, and the use of partially or fully laminated structural materials that provide a tear resistant construction of the package.

The law does not require and it is economically prohibitive to illustrate and teach every possible embodiment of the present claims. Hence, the above-described embodiments are merely exemplary illustrations of implementations set forth for a clear understanding of the principles of the invention. Many variations and modifications may be made to the above-described embodiments without departing from the scope of the claims. All such modifications, combinations, and variations are included herein by the scope of this disclosure and the following claims.

I claim:

1. A packaging system, comprising:

a package including a plurality of hinge panels and a plurality of spine panels, said plurality of hinge panels and said plurality of spine panels being operatively connected to each other;

wherein a first hinge panel includes at least a first door panel that is releasably attached to said first hinge panel, said first door panel including a first severance line and at least one aperture;

wherein a second hinge panel includes at least a second door panel that is releasably attached to said second hinge panel, said second door panel including a second severance line;

at least one item stored proximate to said door panels; and wherein said first hinge panel is attached to said second hinge panel to capture said at least one item, said door panels combining to form at least one releasably attached trap door, with said first severance line cooperatively aligned with said second severance line.

2. A blank for forming a package, comprising:

a first panel including at least one trap door panel releasably attached to said first panel, said first trap door panel including at least a first cut and at least one aperture;

a second panel including at least one trap door panel releasably attached to said second panel, said second trap door panel including at least a second cut; and wherein said first panel is configured to be attached to said second panel such that said first and second trap door panels combine to form a trap door, and said at least first cut and said at least second cut are cooperatively aligned to form a means for tearing the trap door.

3. A method of packaging products, comprising:

cutting a blank from a substrate material, said blank comprising a plurality of operatively connected hinge panels;

folding said blank to form a package, wherein a first hinge panel includes at least a first door panel that is releasably attached to said first hinge panel, said first door panel including a tear notch and at least one aperture; and a second hinge panel includes at least a second door panel that is releasably attached to said second hinge panel, said second door panel including a severance line;

encapsulating at least one item with a tear-resistant material;

attaching said first hinge panel to said second hinge panel so that said tear-resistant material is captured between said door panels to form at least one releasably attached trap door including a means for tearing said trap door.

4. A method of dispensing at least one item from a package, comprising:

pushing a trap door to at least partially disengage the perimeter of the trap door from a hinge panel along a severance line, said trap door including at least one tear notch on a first surface and at least one severance line on a second surface, and at least one blister holding at least one item;

grasping the opposite sides of the tear notch and peeling a portion of said trap door along the severance line to expose at least a portion of said at least one blister; and applying force to said blister for directing at least one item to rupture the backside of said blister to release the item from said blister.

* * * * *